United States Patent [19]

Hall

[11] 4,402,803

[45] Sep. 6, 1983

[54] PROCESS FOR 3-HYDROGEN CEPHEMS

[75] Inventor: David A. Hall, Indianapolis, Ind.

[73] Assignee: Eli Lilly and Company, Indianapolis, Ind.

[21] Appl. No.: 301,602

[22] Filed: Sep. 14, 1981

[51] Int. Cl.[3] ..... C25B 3/04

[52] U.S. Cl. ..... 204/73 R

[58] Field of Search ..... 204/73 R

[56] References Cited

U.S. PATENT DOCUMENTS 4,042,472 8/1977 Hall ..... 204/73 R 4,081,595 3/1978 Nagata et al. ..... 260/243

*Primary Examiner*—Howard S. Williams

*Attorney, Agent, or Firm*—Joseph A. Jones; Arthur R. Whale

[57] ABSTRACT

Cephem compounds having only a hydrogen at the 3-position are prepared by electrolytic reduction of 3-chloro or 3-sulfonyloxy cephems.

12 Claims, 1 Drawing Figure

PROCESS FOR 3-HYDROGEN CEPHEMS

FIELD OF THE INVENTION

This invention belongs to the fields of pharmaceutical chemistry and electrochemistry, and provides a new process for preparing cephem antibiotics which are unsubstituted in the 3-position by the electrolytic reduction of the corresponding 3-chloro or 3-sulfonyloxy compounds.

STATE OF THE ART

The 3-hydrogen cephems are known, and are described in publications such as U.S. Pat. No. 4,269,977, of Peter and Bickel, which shows that they may be prepared by the decarbonylation of the corresponding 3-formyl compounds. Their activity as antibiotics is taught in that patent. The compounds have also been prepared by Spitzer, U.S. Pat. No. 4,065,618, who prepared them by the diborane reduction of 3-amino cephems.

Another synthesis of 3-hydrogen cephems was disclosed by Nagata et al., U.S. Pat. No. 4,081,595, who used the corresponding 3-halogen or 3-sulfonyloxy cephems as starting compounds, and reacted them with reducing metals, reducing metal salts or hydrogenation catalysts.

SUMMARY OF THE INVENTION

The present invention provides a process for preparing cephems of the formula

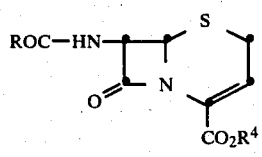

wherein R is $C_1$–$C_3$ alkyl, phenyl, phenyl substituted with 1 or 2 hydroxy, protected hydroxy or $C_1$–$C_4$ alkoxy groups, —$CH_2R^1$, or —$CHR^2R^3$;

$R^1$ is thienyl, tetrazolyl, phenyl, phenoxy, or phenyl or phenoxy substituted with 1 or 2 hydroxy or protected hydroxy groups;

$R^2$ is protected amino, carboxy, protected carboxy, hydroxy or protected hydroxy;

$R^3$ is 1,4-cyclohexadienyl, phenyl, thienyl, or phenyl substituted with 1 or 2 hydroxy or protected hydroxy groups;

$R^4$ is hydrogen or a carboxy-protecting group;

which process comprises reducing a cephem of the formula

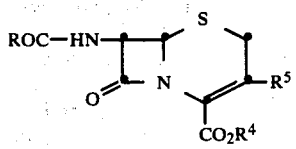

wherein R, $R^1$, $R^2$, $R^3$ and $R^4$ are as defined above, and $R^5$ is chloro, $C_1$–$C_3$ alkanesulfonyloxy or toluenesulfonyloxy;

which process comprises electrolytically reducing a compound of the above formula in an aqueous liquid medium at a pH from about 5 to about 8 in the presence of an electrolyte at the working electrode of an electrolytic cell, said working electrode substantially comprising mercury, lead or zinc, at a temperature from about 0° to about 75°, at a potential in a range from about the potential of the initial onset of current flow of the first reduction to about the potential of the initial onset of current flow of the second reduction.

DESCRIPTION OF THE DRAWING

The FIGURE illustrates a typical voltammogram which results when a system adapted to the practice of this invention is subjected to an increasingly negative potential. The bottom axis, E, measures the potential applied to the working electrode of the cell compared to the reference electrode, and the potential is increasingly negative to the right along the E axis.

The vertical axis, i, indicates current flow through the cell, from the secondary electrode to the working electrode, and increases up the i axis.

Figure 1:
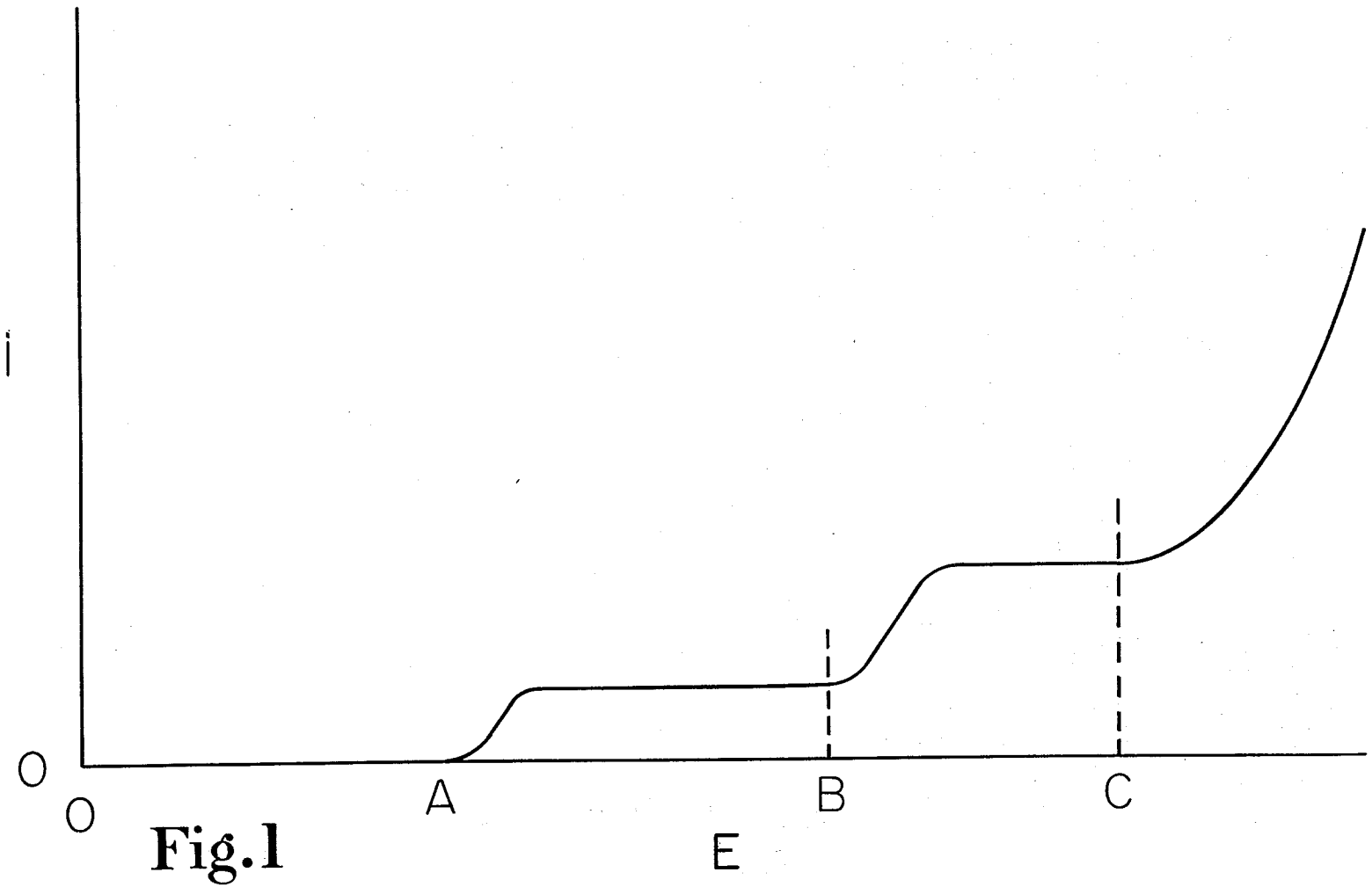

The curve of the FIGURE is drawn in the usual manner, by slowly subjecting the system to increasingly negative potential, measuring the current at each potential, and plotting current against potential. The voltammogram shown represents a compound which has two groups subject to electrolytic reduction.

The first reduction occurs at the point of the E-i curve between A and B. Point A marks the initial onset of current flow of the first reduction, and point B marks the initial onset of current flow of the second reduction.

Point C indicates the onset of background discharge, which is the point where the solvent-electrolyte system begins to break down in an uncontrolled electrolysis, discharging hydrogen.

DESCRIPTION OF THE PREFERRED EMBODIMENTS

The compounds prepared by the process of this invention are known in the cephalosporin art, and are known, for example from U.S. Pat. No. 4,269,977, to be antibiotics. The synthesis of the starting compounds is taught by publications such as U.S. Pat. No. 3,985,737, of Spitzer, and U.S. Pat. No. 3,925,372 and 3,962,227, of Chauvette.

All temperatures in this document are expressed in degrees Celsius.

In the above formulae, the various generalized chemical terms are used in their usual meanings. The terms $C_1$–$C_3$ alkyl and $C_1$–$C_4$ alkoxy refer to groups such as methyl, ethyl, propyl, isopropyl, methoxy, ethoxy, butoxy, t-butoxy, isopropoxy and s-butoxy.

In the antibiotic art, the term "carboxy-protecting group" refers to any suitable group used to block or protect the cephalosporin carboxylic acid functionality while reactions involving other functional sites are carried out. Such carboxylic acid-protecting groups are noted for their ease of cleavage, as for example by hydrolytic or hydrogenolytic methods to the corresponding carboxylic acid. Examples of suitable carboxylic acid-protecting groups are tert-butyl, 1-methylcyclohexyl, benzyl, 4-methoxybenzyl, acetoxymethyl, 1-acetoxyethyl, pivaloyloxymethyl, 1-pivaloyloxyethyl, carboethoxymethyl, 1-carboethoxyoxyethyl, phthalidyl, benzhydryl, phenacyl, dimethylallyl, methoxymethyl, tri($C_1$–$C_3$ alkyl)silyl and succinimidomethyl. Other known carboxylic acid-protecting groups are described by E. Haslam in "Protective Groups in Organic Chemistry," J. F. W. McOmie, Ed., Plenum Press, New York, 1973, Chapter 5. The nature of such groups is not critical; however, because of availability, ease of handling and other desirable properties, certain carboxylic acid-protecting groups are preferred. A preferred selection of carboxylic acid-protecting groups includes acetoxymethyl, 1-acetoxyethyl, pivaloyloxymethyl, 1-pivaloyloxyethyl, carboethoxyoxymethyl, 1-carboxyethoxyoxyethyl and phthalidyl. Another preferred group of carboxy-protecting entities comprises diphenylmethyl, tert-butyl, methoxybenzyl and methyl.

The term protected amino refers to an amino group substituted with one of the commonly employed amino-protecting groups such as t-butoxycarbonyl, benzyloxycarbonyl, 4-methoxybenzyloxycarbonyl and 1-carbomethoxy-2-propenyl. Other accepted amino-protecting groups such as are described by J. W. Barton in *Protective Groups in Organic Chemistry,* Chapter 2, will be recognized by organic chemists as suitable for the purpose.

Similarly, the term protected hydroxy refers to groups formed with a hydroxy group such as formyloxy, benzyloxy, diphenylmethoxy, triphenylmethoxy, trimethylsilyloxy, phenoxycarbonyloxy, t-butoxy, methoxymethoxy and tetrahydropyranyloxy. Other accepted hydroxy-protecting groups, such as those described by C. B. Reese in Chapter 3 of *Protective Groups in Organic Chemistry* will be understood to be included in the term protected hydroxy.

It should be noted, however, that the common 4-nitrobenzyl protecting group is not favored for use in this process. That group will be reduced, to some extent, in the course of the reduction of this invention, and to that extent will be cleaved from the starting compound.

It is believed that the compounds which may be made by the process of this invention are entirely clear from the above description. However, some exemplary compounds will be mentioned for the further assistance of the reader.

7-acetamido-3-cephem-4-carboxylic acid
4-methylcyclohexyl 7-butyramido-3-cephem-4-carboxylate
t-butyl 7-(2-methylpropionamido)-3-cephem-4-carboxylate
7-(4-diphenylmethoxybenzamido)-3-cephem-4-carboxylic acid
7-(4-formyloxy-2-methoxybenzamido)-3-cephem-4-carboxylic acid
benzyl 7-propionamido-3-cephem-4-carboxylate
7-butyramido-3-cephem-4-carboxylic acid
7-benzamido-3-cephem-4-carboxylic acid
acetoxymethyl 7-benzamido-3-cephem-4-carboxylate
7-(2-hydroxy-5-methoxybenzamido)-3-cephem-4-carboxylic acid
pivaloyloxymethyl 7-(4-hydroxybenzamido)-3-cephem-4-carboxylate
7-(3,5-dihydroxybenzamido)-3-cephem-4-carboxylic acid
7-(3-methoxybenzamido)-3-cephem-4-carboxylic acid
t-butyl 7-(3-propoxybenzamido)-3-cephem-4-carboxylate
7-(3-ethoxy-4-methoxybenzamido)-3-cephem-4-carboxylate
7-(2-ethoxy-4-hydroxybenzamido)-3-cephem-4-carboxylic acid
4-methoxybenzyl 7-(2,4-dimethoxybenzamido)-3-cephem-4-carboxylate
7-(3-hydroxybenzamido)-3-cephem-4-carboxylate
diphenylmethyl 7-(3-s-butoxybenzamido)-3-cephem-4-carboxylate
7-(thien-2-ylacetamido)-3-cephem-4-carboxylic acid
7-(4-methoxymethoxyphenylacetamido)-3-cephem-4-carboxylic acid
7-[2,4-bis(trimethylsilyloxy)phenylacetamido]-3-cephem-4-carboxylic acid
7-carboxy(4-phenoxycarbonyloxyphenyl)acetamido-3-cephem-4-carboxylic acid
diphenylmethyl 7-(tetrazol-1-ylacetamido)-3-cephem-4-carboxylic acid
7-(tetrazol-5-ylacetamido)-3-cephem-4-carboxylic acid
methoxymethyl 7-phenylacetamido-3-cephem-4-carboxylate
7-phenoxyacetamido-3-cephem-4-carboxylic acid
4-methoxybenzyl 7-(2,4-dihydroxyphenylacetamido)-3-cephem-4-carboxylate
7-(4-hydroxyphenoxyacetamido)-3-cephem-4-carboxylic acid
7-(3-hydroxyphenylacetamido)-3-cephem-4-carboxylic acid
t-butyl 7-(4-hydroxyphenoxyacetamido)-3-cephem-4-carboxylate
acetoxymethyl 7-(2,5-dihydroxyphenylacetamido)-3-cephem-4-carboxylate
7-(2-hydroxyphenoxyacetamido)-3-cephem-4-carboxylic acid
7-(1,4-cyclohexadienyl)carboxyacetamido-3-cephem-4-carboxylic acid
4-methoxybenzyl-7-(phenyl)hydroxyacetamido-3-cephem-4-carboxylate
acetoxymethyl 7-(thien-2-yl)(t-butoxyformamido)acetamido-3-cephem-4-carboxylate
7-(t-butoxyformamido)phenylacetamido-3-cephem-4-carboxylic acid
diphenylmethyl 7-(benzyloxyformamido)(4-hydroxyphenyl)acetamido-3-cephem-4-carboxylate
7-formyloxy(2,4-diformyloxyphenyl)acetamido-3-cephem-4-carboxylic acid
4-methoxybenzyl 7-(4-methoxybenzyloxyformamido)-(2,4-dihydroxyphenyl)acetamido-3-cephem-4-carboxylate
benzyl 7-(3-hydroxyphenyl)formyloxyacetamido-3-cephem-4-carboxylate
7-(4-hydroxyphenyl)diphenylmethoxyacetamido-3-cephem-4-carboxylic acid
7-(2,6-dihydroxyphenyl)benzyloxyacetamido-3-cephem-4-carboxylic acid
diphenylmethyl 7-(3,5-dihydroxyphenyl)diphenylmethoxyacetamido-3-cephem-4-carboxylate
7-(t-butoxycarbonyl)phenylacetamido-3-cephem-4-carboxylic acid
7-(thien-2-yl)benzyloxycarbonylacetamido-3-cephem-4-carboxylic acid
diphenylmethyl 7-(4-methoxybenzyloxycarbonyl)-phenylacetamido-3-cephem-4-carboxylate
7-(acetoxymethoxycarbonyl)phenylacetamido-3-cephem-4-carboxylic acid Certain of the compounds described by the formula above are preferred products of this invention. Such preferred compounds are those of the following sub-generic types; it will be understood that additional preferred compounds may be obtained by combining various of the limitations of the named preferred sub-genera.

(a) $R^4$ is hydrogen;
(b) $R^4$ is a carboxy-protecting group;
(c) R is phenyl or substituted phenyl;

(d) R is $—CH_2R^1$;
(e) $R^1$ is thienyl;
(f) $R^1$ is tetrazolyl;
(g) $R^1$ is phenyl or phenoxy;
(h) $R^1$ is substituted phenyl or phenoxy;
(i) R is $—CHR^2R^3$;
(j) $R^2$ is protected amino;
(k) $R^2$ is carboxy or protected carboxy;
(l) $R^2$ is hydroxy or protected hydroxy;
(m) $R^2$ is protected amino, protected carboxy or protected hydroxy;
(n) $R^3$ is 1,4-cyclohexadienyl;
(o) $R^3$ is thienyl;
(p) $R^3$ is phenyl;
(q) $R^3$ is substituted phenyl.

The electrolytic cells used for the process of this invention are the conventional types now known in the electrochemical art. This invention does not provide and does not need any new cells or other equipment. Some discussion of electrolytical cells will be given, however.

An electrolytic cell of the type used for electrolytic reductions has a working electrode, sometimes called the cathode, at which the reduction takes place. The working electrode is maintained at a potential which is negative with respect to the auxiliary electrode, or anode, at which only electrolyte reactions should take place. A reference electrode is usually used, also. The reference electrode, at which no reactions should take place, supplies a reference point from which the potential of the working electrode is measured. A typical and frequently-used reference electrode is the saturated calomel electrode; others are the mercury/mercuric oxide electrode and the silver/silver chloride electrode. The reference electrode is electrically connected to the working fluid through a conductive bridge or a porous junction.

Cells are very often divided into compartments, so that each of the electrodes is immersed in fluid which is physically separated from the fluids of the other compartments, but is electrically connected to them. Such division of the cell is optional in the context of the present invention, unless the compound to be reduced bears a group which can be electrically oxidized, such as the compounds in which R is 4-hydroxybenzyl. In general, groups having oxygen substitution on an aromatic ring are likely to be readily oxidized. The oxidizability of the starting compound may be readily determined by running a voltammogram on the auxiliary electrode in a positive direction with respect to the reference electrode. The presence of inflection points, such as are shown in FIG. 1, indicates that one or more oxidizable groups are present and that a divided cell is necessary, so that the auxiliary electrode is physically separated from the working fluid which contains the compound.

The arrangement of electrolytic cells, the construction of electrodes, and the materials which may be effectively used as dividers are all part of the common knowledge of the electrochemical art, and may easily be learned by reference to text books and journal articles. Particularly useful text books which may be mentioned include "Organic Electrochemistry", M. M. Baizer, Editor, Marcel Dekker, Inc., New York, 1973, and "Technique of Electroorganic Synthesis", N. L. Weinberg, Editor, John Wiley and Sons, New York, 1974.

The working electrodes are composed of mercury, zinc or lead. The electrodes should be rather highly purified, as is normally the case in electrochemistry. The form of the electrode is not important; it may be solid sheet, gauze or cloth, a basket of shot, or a fluidized bed of particles, with equally good results. The electrode may also be made of an inert substrate plated with the electrode metal, or it may be made in the form of a sheet of the electrode composition, wrapped with gauze of the same composition to increase the electrode area.

The auxiliary electrode does not participate in the reductive process, and so it may be made of any suitable substance which is not attacked by the oxidative side of the electrolytic process. Auxiliary electrodes are most often made of the noble metals, especially platinum, or of carbon. Platinum oxide, or platinum coated with platinum oxide, is the preferred anode composition. Lead oxide, silver oxide and such metallic oxides are also usable auxiliary electrode compositions; oxides are, of course, adhered to a stable substrate for support. For example, titanium coated with ruthenium oxide is a very suitable auxiliary electrode.

It is most effective to arrange the cell so that the distance between the auxiliary electrode and the working electrode is everywhere the same, and is as small as possible. The relationship is desirable in all electrolytic processes, to maximize current flow and minimize temperature rise caused by the resistance of the fluid to the flow of current.

If an undivided cell is used, the fluid in contact with both the working electrode and the auxiliary electrode will be the same. If the cell is divided, however, the working fluid will undoubtedly be different from the fluid in the auxiliary electrode compartment.

The working fluid used in this invention is an aqueous mixture. The organic solvent in the working fluid, if any, may be either water-miscible or water-immiscible. It is preferred to use a water-miscible solvent, so that the working fluid is a homogeneous solution.

Suitable water-miscible organic solvents include the amides, especially dimethylformamide and dimethylacetamide, acetone, the water-miscible alkanols, such as methanol, ethanol and propanol, and tetrahydrofuran.

If a water-immiscible solvent is used in the working fluid, the choice of solvents is extremely broad, because any solvent may be used which is not reduced at the working electrode. Especially desirable solvents include the halogenated solvents, such as dichloromethane, 1,1,2-trichloroethane, chlorobenzene, and the like. Other immiscible solvents which may advantageously be used include the ketones including methyl ethyl ketone, methyl butyl ketone and methyl isobutyl ketone, to methion only those which are economically available in commerce, the aromatic solvents such as benzene, toluene and the xylenes, the alkanes such as pentane, hexane and the octanes, the alcohols such as phenol, the butyl alcohols and the like, and ethers such as diethyl ether, diisopropyl ether and hexahydropyran.

It is usually necessary to use a buffer system in the working fluid to maintain the pH at the desired level. The salts, bases or acids of the buffer system usually provide sufficient conductivity for the electrolysis. However, additional electrolytes may be added to the system, as is often done in electrochemistry, so long as the additional electrolytes are inert to the process and do not change the pH.

Cephem compounds are not stable in basic solution, and it is therefore preferred to operate the present process at a pH which is acid or nearly neutral. A preferred pH range is from about 5 to about 8, more preferably from about 5 to about 7. It may be necessary in some instances to add acid to the working fluid, to attain and maintain the desired pH. In such cases, it is preferable to use sulfuric acid or hydrochloric acid, for the sake of economy and convenience. Other strong acids such as phosphoric acid, nitric acid, p-toluenesulfonic acid and the like may also be used as desired.

If the process of this invention is to be carried out in a divided cell, the divider may be made of any of the materials commonly used in electrochemistry for the purpose. Especially useful dividers are made from the ion exchange membranes, most especially those which can pass cations. Dividers may also advantageously be made of finely porous substances such as ceramic membranes and sintered glass membranes. Such porous dividers may be made permeable to ions, but not to the fluids themselves, by sealing the membranes with a conductive gel, of which a typical example is agar gel saturated with an ionic substance such as, for example, potassium sulfate.

When the auxiliary electrode occupies a cell compartment by itself, it is immersed in a conductive fluid. If the divider is a porous membrane, it is advisable to provide an auxiliary electrode fluid which is compatible with the working fluid, such as an aqueous solution of the mineral acid used in the working fluid. If the cell divider is porous only to ions, then the auxiliary electrode fluid may be any convenient conductive fluid, such as dilute aqueous solutions of ionizable salts and acids.

The temperature of the process is from about 0° to about 75°, preferably from about 0° to about 30°.

The potential of the working electrode, or the potential between the working electrode and the auxiliary electrode, may be controlled in various ways. The most effective and precise way to control the potential is to use a reference electrode, with its junction to the working fluid placed as physically close as possible to the working electrode. The desired potential for the process is determined from examination of a voltammogram of the system, and the potential between the working electrode and the auxiliary electrode is adjusted to give the desired constant potential between the reference electrode and the working electrode. This method of control is much more effective than control by the overall voltage between the working electrode and the auxiliary electrode, because that voltage depends on the condition of the dividing membrane, if any, the concentration of the acid in the working fluid, and the concentration of the compound to be reduced in the working fluid.

Similarly it is relatively inefficient to control the system by means of the current flow between the auxiliary electrode and the working electrode, because the current flow is directly dependent on the concentration of the compound to be reduced, as well as upon the physical condition of the electrodes and of the divider. However, when an individual reduction has been thoroughly studied and the relationship between current, time and concentration is known, controlled-current electrolysis can be used for production of repeated batches.

Thus, the best way to control the system is by the potential between a reference electrode and the working electrode, and the control most advantageously is provided by an automatic instrument which constantly senses that potential and adjusts the voltage between the working electrode and auxiliary electrode accordingly. Such instruments are now readily available; one maker of them is Princeton Applied Research, Inc., Princeton, N.J., U.S.A.

As has been briefly discussed above, the best potential for operating the process of this invention with any given combination of electrodes, working fluid and compound is determined according to the routine method of the electrochemical art, by running a voltammogram of the system.

It is not possible, of course, to name a precise potential range for the operation of the process of this invention, since the potential for every system will necessarily be different. It has been observed, however, that the potential of the working electrode for reductions according to this process is from about 1.5 volts to about 2 volts, relative to a saturated calomel reference electrode, in the majority of systems which have been used.

The reduction of this invention appears to be a 2-electron process, and so the reduction of a grammole of compound requires 193,000 coulombs. It should be noted, however, that one of the reduction products apparently acts as a catalyst for the reduction of hydrogen. Therefore, more than the theoretical amount of current must be passed to complete the reduction.

Electrolytic cells usually require good agitation, and the process of this invention is typical in this respect. It has been found advisable to provide enough agitation of the working fluid to keep the surface of the electrode thoroughly swept, so that a fresh supply of compound to be reduced is constantly supplied to the working electrode. Further, when a water-immiscible solvent is used in the working fluid, it is necessary to agitate the fluid sufficiently well to keep the two phases of the working fluid intimately mixed in the form of fine droplets.

The electrochemical art has long known that electrolytic processes are carried out more advantageously in flow cells than in batch electrolytic cells, in general. A flow cell is an electrolytic cell arranged for the constant passage of the working fluid through the cell. The cell volume may be quite small, and the current density rather high, to achieve the desired extent of reaction in a single pass through the cell, or the current may be lower and the volume higher, with the expectation that a number of passes through the cell will be necessary. In either event, the flow cell is operated continuously with no interruptions for filling and emptying the cell, and the associated operations of product isolation and temperature control are carried on outside the cell.

Flow cells are set up just as are batch cells, except for the necessary provisions for entry and exit of the working fluid. A flow cell may be divided, if necessary, in the usual manner. It is often possible to design a flow cell with the electrodes spaced advantageously close to each other, because the agitation of the working fluid is provided by its own flow velocity and it is unnecessary to provide for mechanical agitation of the cell. For example, a flow cell is often built in the form of a plate-and-frame filter press, with the electrodes in sheet form, clamped between the frames.

The concentration of the compound to be reduced in the working fluid is widely variable and is limited only by the solubility of the compound. Of course, it is most economical to use relatively high concentrations, in order to obtain the maximum effect from the solvents used in the process. However, workup of the fluid and isolation of the product from it is frequently more difficult when highly concentrated working fluids are used.

Accordingly, it has not been advantageous in practice to use concentrations of compound in the working fluid higher than about 20% weight/volume.

The product is recovered from the working fluid by a conventional isolation procedure. It is usually best to remove organic solvent from the working fluid by evaporation under vacuum. If the product is in acid form, it is then most easily recovered by making the mixture quite acid, such as pH 1 or 2, and extracting the mixture with a solvent such as ethyl acetate. If the product is an ester, it is usually most easily recovered by conventional extraction with a suitable solvent for the product. Such isolation procedures can be automated and made continuous to extract the product efficiently from a continuous flow process.

The reader will note that many of the compounds prepared by the process of this invention bear amino-, carboxy- or hydroxy-protecting groups. It will be understood that such groups must be removed, in general, to prepare antibiotically active compounds. The protecting groups are removed by the commonly-used procedures of the art, as taught, for example, by "Protective Groups in Organic Chemistry", cited above.

The following examples are included to assist the reder in understanding the process of this invention, and to assure that a skilled electrochemist can carry out any desired process of this invention. The products of the examples were identified by instrumental analytical techniques, as will be explained in the individual examples.

EXAMPLE 1

7-(thien-2-ylacetamido)-3-cephem-4-carboxylic acid

Fifty ml. of working fluid was prepared, containing 6.4 mg./ml. of 7-(thien-2-ylacetamido)-3-chloro-3-cephem-4-carboxylic acid in 0.25 molar pH 8 McIlvaine buffer containing 0.0375 molar tetrabutylammonium iodide. The McIlvaine buffer was prepared according to McIlvaine's article at *Anal. Chem.* 28, 1179 (1956). The measured pH of the working fluid was 7.3. It was transferred to the cathode compartment of an electrolysis cell having a mercury ring working electrode and a stirrer. The circular auxiliary electrode compartment was suspended over the mercury pool, and consisted of a platinum wire in toroidal shape over a 4% agar gel supported by a medium porosity sintered glass frit. The auxiliary fluid was saturated aqueous potassium sulfate. The cell was stoppered, and a deaerating frit, pH electrode, reference electrode and a delivery tube through which 2 N sulfuric acid could be added were installed. The reference electrode was a Beckman fiber-junction saturated calomel electrode.

The cell stirrer was turned on, and argon was bubbled through the working fluid through the deaerating frit for about 15 minutes. After dearation the deaerating frit was raised to just above the surface of the working fluid, and argon was flowed through it throughout the experiment. The pH was constantly monitored, and was held constant with an automatic titrator. The temperature of the working fluid was held constant at 25° by circulating water through the jacket of the cell. A source of controlled electricity (a Princeton Applied Research Model 170 electrochemistry system) was connected to the electrodes of the cell, and a voltammetry run was made to find the potential (measured between the working electrode and the reference electrode) at which the rising portion of the voltammogram changed slope. The potential was −2.0 volts, and that constant potential was set and maintained during the passage of 462 coulombs through the cell. At that point, the starting compound was substantially consumed, as indicated both by the amount of current passed, and by the disappearance of the starting compound spot on thin layer chromatograms.

The working fluid was then removed from the cell, and it was layered with about 100 ml. of ethyl acetate and made acid to about pH 1.5. The layers were then separated, the aqueous phase was extracted twice more with ethyl acetate, and the combined ethyl acetate fractions were backwashed with about 50 ml. of 0.5 N hydrochloric acid. The ethyl acetate fraction was then dried over magnesium sulfate, filtered and evaporated to dryness under vacuum. The product mixture, containing various substances, was converted to methyl esters by reaction with diazomethane, and the methyl ester of the product was isolated by crystallization, giving 10 mg. of the methyl ester. It was identified by nuclear magnetic resonance analysis, on a 100 mHz. instrument, using $CDCl_3$ as the solvent, and trimethylsilane as the internal standard. The following characteristic features were noted.

NMR δ 7.25 and 6.98 (d and t, 3H, thienyl protons); 6.51 (q, 1H, C3); 6.40 (d, 1H, —NH—); 5.88 (q, 1H, C7); 4.95 (d, 1H, C6); 3.83 and 3.85 (s and s, 5H, $COCH_2$and $CO_2CH_3$); 3.48 (octet, 2H, C2).

EXAMPLE 2

7-(t-butoxyformamido)phenylacetamido-3-cephem-4-carboxylic acid

Eighty ml. of working fluid was prepared, containing 2.5 mg./ml. of the 3-chloro derivative of the product, in a mixture of 30% absolute methanol and 70%, by volume, of 0.6 molar pH 5.4 McIlvaine buffer. The measured pH of the working fluid was 5.7. The electrolysis cell was set up as described in Example 1, and the electrolysis was carried out substantially as described in that Example, at −1.6 volts. The product was isolated by first evaporating the ethanol from the fluid, and then working up the aqueous portion of the fluid as described in Example 1 to obtain 170 mg. of impure product. The reduction was repeated several times, and various products were found to have the β-lactam group intact, by infrared analysis, and to have the expected molecular ion, 447, by mass spectroscopy.

EXAMPLE 3

7-(thien-2-ylacetamido)-3-cephem-4-carboxylic acid

A 200 mg. portion of 7-(thien-2-ylacetamido)-3-methanesulfonyloxyl-3-cephem-4-carboxylic acid was dissolved in a working fluid containing 2.5 mg./ml. of the starting compound, 35% by volume of ethanol, and 64% by volume of 1.0 molar pH 7.0 McIlvaine buffer. The measured pH of the working fluid was 7.5. The electrolysis was carried out as described in Example 1 in the same type of cell described in Example 1, and the product was worked up as described in Example 2 to obtain about 130 mg. of crude product. The product was converted to the methyl ester, and submitted to mass spectroscopy, which revealed the presence of molecular ions of mass 337 and 338, confirming that the desired product was obtained.

I claim:

1. A process for preparing cephems of the formula

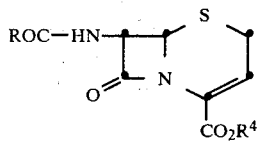

wherein

R is $C_1$–$C_3$ alkyl, phenyl, phenyl substituted with 1 or 2 hydroxy, protected hydroxy or $C_1$–$C_4$ alkoxy groups, —$CH_2R^2$, or —$CHR^2R^3$;

$R^1$ is thienyl, tetrazolyl, phenyl, phenoxy, or phenyl or phenoxy substituted with 1 or 2 hydroxy or protected hydroxy groups;

$R^2$ is protected amino, carboxy, protected carboxy, hydroxy or protected hydroxy;

$R^3$ is 1,4-cyclohexadienyl, phenyl, thienyl, or phenyl substituted with 1 or 2 hydroxy or protected hydroxy groups;

$R^4$ is hydrogen or a carboxy-protecting group; which process comprises reducing a cephem of the formula

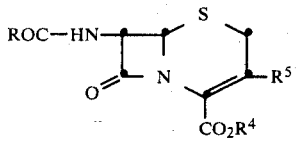

wherein

R, $R^1$, $R^2$, $R^3$ and $R^4$ are as defined above, and $R^5$ is chloro, $C_1$–$C_3$ alkanesulfonyloxy or toluenesulfonyloxy;

which process comprises electrolytically reducing a compound of the above formula in an aqueous liquid medium at a pH from about 5 to about 8 in the presence of an electrolyte at the working electrode of an electrolytic cell, said working electrode substantially comprising mercury, lead or zinc, at a temperature from about 0° to about 75°, at a potential in a range from about the potential of the initial onset of current flow of the first reduction to about the potential of the initial onset of current flow of the second reduction.

2. A process of claim 1 wherein the compound is a compound wherein R is —$CH_2R^1$.

3. A process of claim 2 wherein the compound is a compound wherein $R^1$ is phenyl or phenoxy.

4. A process of claim 3 wherein the starting compound is a compound wherein $R^5$ is methanesulfonyloxy.

5. A process of claim 3 wherein the starting compound is a compound wherein $R^5$ is toluenesulfonyloxy.

6. A process of claim 2 wherein the compound is a compound wherein $R^1$ is substituted phenyl or phenoxy.

7. A process of claim 1 wherein the compound is a compound wherein $R^1$ is —$CH_2R^2R^3$.

8. A process of claim 1 wherein the compound is a compound wherein $R^2$ is protected amino, protected carboxy or protected hydroxy.

9. A process of claim 8 wherein the compound is a compound wherein $R^3$ is phenyl or substituted phenyl.

10. A process of claim 1 wherein the product is 7-(t-butoxyformamido)phenylacetamido-3-cephem-4-carboxylic acid.

11. A process of any one of claims 1–10 wherein the liquid medium is aqueous alkanol.

12. A process of any one of claims 1–5 wherein the temperature is from about 0° to about 30°.

* * * * *

UNITED STATES PATENT AND TRADEMARK OFFICE

CERTIFICATE OF CORRECTION

PATENT NO. : 4,402,803

DATED : September 6, 1983

INVENTOR(S) : David A. Hall

It is certified that error appears in the above-identified patent and that said Letters Patent are hereby corrected as shown below:

Column 10, line 57 "64%" should read --65%--

Signed and Sealed this

*Ninth* Day of *October 1984*

[SEAL]

*Attest:*

GERALD J. MOSSINGHOFF

*Attesting Officer*

*Commissioner of Patents and Trademarks*